US007921899B2

(12) United States Patent
Chan et al.

(10) Patent No.: US 7,921,899 B2
(45) **Date of Patent: *Apr. 12, 2011**

(54) METHOD FOR MAKING MAGNESIUM-BASED CARBON NANOTUBE COMPOSITE MATERIAL

(75) Inventors: Kam-Shau Chan, Taipei Hsien (TW); Cheng-Shi Chen, Fullerton (TW); Guang-Liang Sheu, Taipei Hsien (TW); Qing-Chun Du, Shenzhen (CN); Wen-Zhen Li, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 421 days.

This patent is subject to a terminal disclaimer.

(21) Appl. No.: 12/060,101

(22) Filed: Mar. 31, 2008

(65) Prior Publication Data

US 2009/0127743 A1 May 21, 2009

(30) Foreign Application Priority Data

Nov. 16, 2007 (CN) ..... 2007 1 0124548

(51) Int. Cl.
*B22D 19/14* (2006.01)
*B22D 17/00* (2006.01)

(52) U.S. Cl. ..... 164/97; 164/113

(58) Field of Classification Search ..... 164/97, 164/113, 900; 977/742
See application file for complete search history.

(56) References Cited

U.S. PATENT DOCUMENTS

| | | | | |
|---|---|---|---|---|
| 3,967,485 | A * | 7/1976 | Oguchi et al. | 72/60 |
| 6,860,314 | B1 * | 3/2005 | Koide et al. | 164/113 |
| 7,509,993 | B1 * | 3/2009 | Turng et al. | 164/113 |
| 7,712,512 | B2 * | 5/2010 | Suganuma et al. | 164/113 |
| 7,824,461 | B2 * | 11/2010 | Chan et al. | 75/10.13 |
| 2009/0056499 | A1 * | 3/2009 | Chan et al. | 75/10.67 |
| 2009/0057957 | A1 * | 3/2009 | Chan et al. | 264/328.2 |

* cited by examiner

*Primary Examiner* — Kevin P Kerns
(74) *Attorney, Agent, or Firm* — Andrew C. Cheng

(57) ABSTRACT

A method for fabricating a magnesium-based composite material, the method includes the steps of: (a) providing a magnesium-based melt and a plurality of carbon nanotubes, mixing the carbon nanotubes with the magnesium-based melt to achieve a mixture; (b) injecting the mixture into at least one mold to achieve a preform; and (c) extruding the preform to achieve the magnesium-based carbon nanotube composite material.

17 Claims, 2 Drawing Sheets

METHOD FOR MAKING MAGNESIUM-BASED CARBON NANOTUBE COMPOSITE MATERIAL

BACKGROUND

1. Field of the Invention

The present invention relates to methods for fabricating composite materials and, particularly, to a method for fabricating a magnesium-based carbon nanotube composite material.

2. Discussion of Related Art

Nowadays, various alloys have been developed for special applications. Among these alloys, magnesium alloys have relatively superior mechanical properties, such as low density, good wear resistance, and high elastic modulus. However, the toughness and the strength of the magnesium alloys are not able to meet the increasing needs of the automotive and aerospace industry for tougher and stronger alloys.

To address the above-described problems, magnesium-based composite materials have been developed. In the magnesium-based composite material, nanoscale reinforcements (e.g. carbon nanotubes and carbon nanofibers) are mixed with the magnesium metal or alloy. The most common methods for making the magnesium-based composite material are through thixomolding and die-casting. However, in die-casting, the magnesium or magnesium alloy is easily oxidized. In thixomolding, the nanoscale reinforcements are added to melted metal or alloy and are prone to aggregate. As such, the nanoscale reinforcements can't be well dispersed.

What is needed, therefore, is to provide a method for fabricating a magnesium-based carbon nanotube composite material, in which the above problems are eliminated or at least alleviated.

SUMMARY

In one embodiment, a method for fabricating the above-described magnesium-based carbon nanotube composite material includes the steps of: (a) providing a magnesium-based melt and a plurality of carbon nanotubes, mixing the carbon nanotubes with the magnesium-based melt to achieve a mixture; (b) injecting the mixture into at least one mold to achieve a preform; and (c) extruding the preform to achieve the magnesium-based carbon nanotube composite material.

Other advantages and novel features of the present method for fabricating the magnesium-based carbon nanotube composite material will become more apparent from the following detailed description of preferred embodiments when taken in conjunction with the accompanying drawings.

BRIEF DESCRIPTION OF THE DRAWINGS

Many aspects of the present method for fabricating the magnesium-based carbon nanotube composite material can be better understood with reference to the following drawings. The components in the drawings are not necessarily to scale, the emphasis instead being placed upon clearly illustrating the principles of the present method for fabricating the magnesium-based carbon nanotube composite material.

Figure 1:
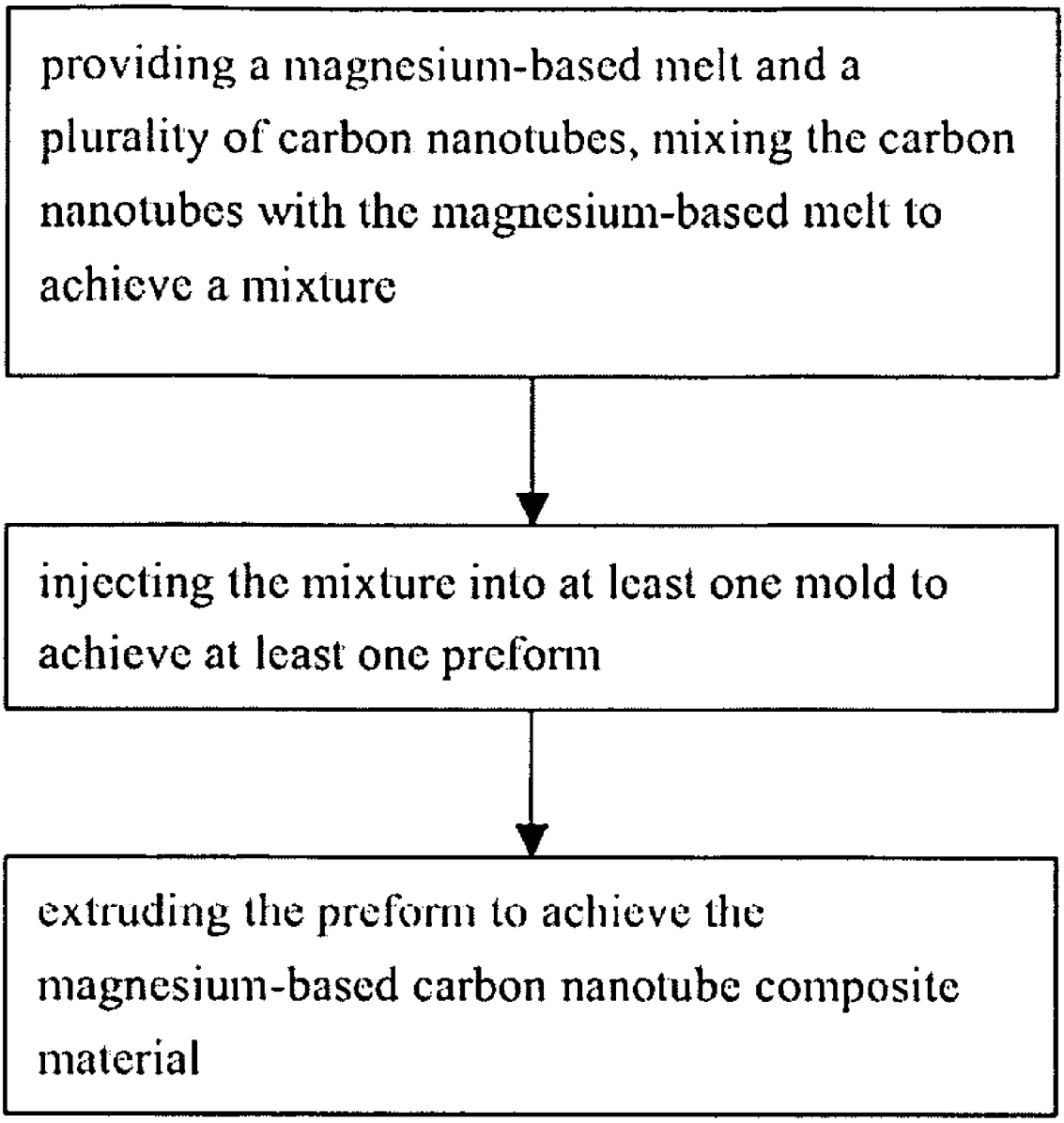
FIG. 1 is a flow chart of a method for fabricating a magnesium-based carbon nanotube composite material, in accordance with a present embodiment.

Corresponding reference characters indicate corresponding parts throughout the several views. The exemplifications set out herein illustrate at least one preferred embodiment of the present method for fabricating the magnesium-based carbon nanotube composite material, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the method for fabricating the magnesium-based carbon nanotube composite material.

Referring to FIG. 1, a method for fabricating a magnesium-based carbon nanotube composite material includes the steps of: (a) providing a magnesium-based melt 2 and a plurality of carbon nanotubes 1, mixing the carbon nanotubes 1 with the magnesium-based melt 2 to achieve a mixture; (b) injecting the mixture into at least one mold, to achieve a preform 6; and (c) extruding the preform 6, to achieve the magnesium-based carbon nanotube composite material.

Figure 2:
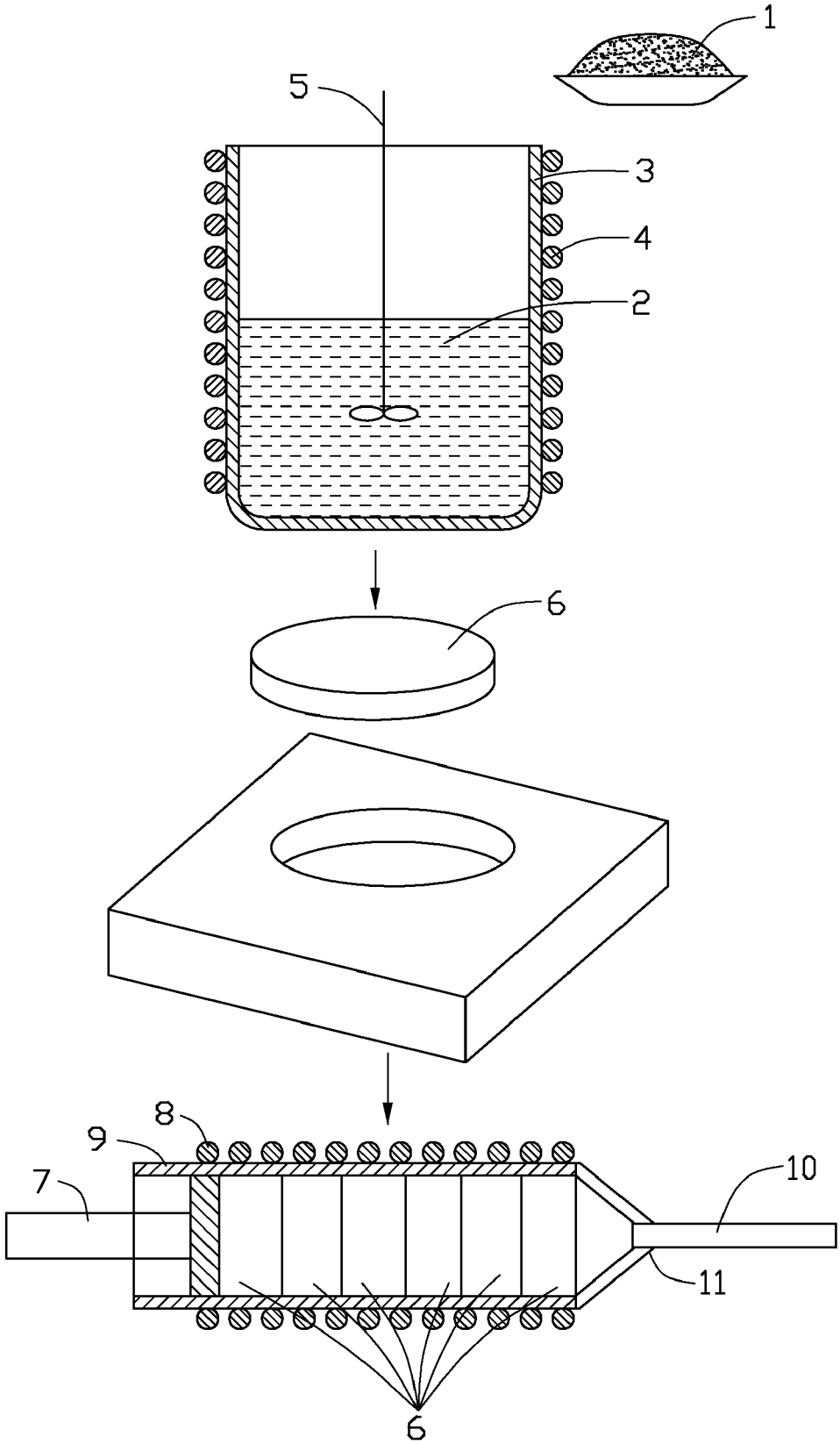
FIG. 2 is a schematic view of the fabrication of the magnesium-based composite material of FIG. 1.

Referring to FIG. 2, in step (a), the carbon nanotubes 1 and the magnesium-based melt 2 are mixed in a mixing device. The mixing device includes a container 3 with a protective gas therein, a stirrer 5 disposed in a center of the container 3, and a heater 4 (e.g. hot wires) disposed on a outer wall of the container 3. Quite suitably, the protective gas can, beneficially, be made up of at least one of nitrogen ($N_2$), ammonia ($NH_3$), and a noble gas. The heater 4 heats the container to a predetermined temperature. Quite usefully, the temperature can be in the approximate range from 550° C. to 750° C. In the present embodiment, the temperature is at about 700° C.

The magnesium-based melt 2 is in a semi-solid state and is filled into the container 3 at an elevated temperature. Then, the carbon nanotubes are slowly added into the container 3, while the stirrer 5 mixes the carbon nanotubes with the magnesium-based melt, forming a mixture in the container 3.

The carbon nanotubes 1 can, beneficially, be selected from a group consisting of single-wall carbon nanotubes, double-wall carbon nanotubes, multi-wall carbon nanotubes, and combinations thereof. A diameter of the carbon nanotubes can, opportunely, be in the approximate range from 1 to 150 nanometers. A length of the carbon nanotubes can, suitably, be in the approximate range from 1 to 10 microns. In the present embodiment, the carbon nanotubes 1 are single-wall carbon nanotubes, the diameter thereof is about 20 to 30 nanometers, and the length thereof is about 3 to 4 microns. A weight percentage of the carbon nanotubes 1 in the mixture can, suitably, be in the approximate range from 1% to 5%. In the present embodiment, the weight percentage of the carbon nanotubes 1 in the mixture is about 3%.

The material of the magnesium-based melt can, beneficially, be pure magnesium or magnesium-based alloys. The components of the magnesium-based alloys include magnesium and other elements selected from a group consisting of zinc (Zn), manganese (Mn), aluminum (Al), thorium (Th), lithium (Li), silver, calcium (Ca), and any combination thereof. A weight ratio of the magnesium to the other elements can advantageously, be more than about 4:1. In the present embodiment, the magnesium-based melt is pure magnesium.

In step (b), the mixture can, advantageously, be injected into a plurality of molds in protective gas. After cooled to room temperature, the mixture is solidified to form a plurality of preforms 6 (i.e. ingots). Then, the preforms 6 can be removed from the molds. Quite suitably, the protective gas can, beneficially, be made up of at least one of nitrogen ($N_2$), ammonia ($NH_3$), and a noble gas.

A diameter of the preforms 6 can, suitably, be in the approximate range from 5 to 10 centimeters. A thickness of the preforms 6 can, usefully, be in the approximate range from 0.1 to 1 centimeter. In the present embodiment, the diameter of the preforms 6 is about 8 centimeters, and the thickness of the preforms 6 is about 0.5 centimeters.

It is to be understood that, the molds are in an oblate shape, thus, the specific areas thereof are relatively large. As such, the mixture can be solidified quickly to form the preforms 6 to avoid deposition and segregation of the carbon nanotubes in the preforms.

In step (c), a syringe-shaped extruding device can be provided and includes a cylindrical tube 9, a plunger 7 disposed at one end thereof, and an exit 11 positioned at the other end thereof. The diameter of the cylindrical tube 9 can, beneficially, be larger than the diameters of the preforms 6. The diameter of the exit 11 is smaller than the diameter of the cylindrical tube 9. The preforms 6 can, suitably, be disposed in the cylindrical tube 9 and extruded from the exit 11 by the plunger 7. Further, the extruding device can also include a heater 8 on the outer wall of the cylindrical tube 9 to heat the preforms 6 to a temperature in the approximate range from 300° C. to 450° C. In the present embodiment, the preforms 6 are heated to about 400° C. At an elevated temperature, the preforms 6 are in a thixotropic state and can be extruded by the plunger 7 to form a magnesium-based carbon nanotube composite material 10. The shape of the magnesium-based carbon nanotube composite material 10 is determined by the shape of the exit 11. In the present embodiment, the exit 11 is rectangular-shaped.

In the extrusion step, the preforms 6 experience a deformation process when extruded from the exit 11. In the deformation process, different parts of the preforms 6 will be mixed together. Accordingly, the carbon nanotubes can be redistributed in the preforms. As such, the dispersion uniformity of the carbon nanotubes in the magnesium-based carbon nanotube composite material 10 can, thus, be improved. The achieved magnesium-based carbon nanotube composite material 10 strong, tough, and has a high density, and can be widely used in a variety of fields such as the automotive and aerospace industries.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for fabricating a magnesium-based composite material, the method comprising the steps of (a) providing a magnesium-based melt and a plurality of carbon nanotubes, mixing the plurality of carbon nanotubes with the magnesium-based melt to achieve a mixture;

(b) injecting the mixture into at least one mold, and cooling down and solidifying the mixture to room temperature to achieve at least one preform; and (c) extruding the at least one preform to achieve the magnesium-based carbon nanotube composite material;

wherein step (c) further comprises substeps of:

providing an extruding device having one exit;

disposing the at least one preform in the extruding device;

heating the at least one preform at a temperature in an approximate range from 300° C. to 450° C.; and extruding the at least one preform from the exit of the extruding device to achieve the magnesium-based carbon nanotube composite material.

2. The method as claimed in claim 1, wherein the plurality of carbon nanotubes are selected from a group consisting of single-wall carbon nanotubes, double-wall carbon nanotubes, multi-wall carbon nanotubes, and combinations thereof.

3. The method as claimed in claim 1, wherein a diameter of the plurality of carbon nanotubes is in an approximate range from 1 to 150 nanometers, and a length of the plurality of carbon nanotubes is in an approximate range from 1 to 10 microns.

4. The method as claimed in claim 1, wherein a weight percentage of the plurality of carbon nanotubes in the mixture is in an approximate range from 1% to 5%.

5. The method as claimed in claim 1, wherein the material of the magnesium-based melt is one of pure magnesium and magnesium-based alloys.

6. The method as claimed in claim 5, wherein components of the magnesium-based alloys comprise magnesium and other elements selected from the group consisting of zinc, manganese, aluminum, thorium, lithium, silver, calcium, and any combination thereof.

7. The method as claimed in claim 6, wherein a weight ratio of the magnesium to the other elements is above about 4:1.

8. The method as claimed in claim 1, wherein the at least one preform is an oblate ingot.

9. The method as claimed in claim 8, wherein a diameter of the at least one preform is in an approximate range from 5 to 10 centimeters, and a thickness of the at least one preform is in an approximate range from 0.1 to 1 centimeter.

10. The method as claimed in claim 1, wherein step (a) further comprises substeps of:

filling the magnesium-based melt into a container at a temperature in an approximate range from 550° C. to 750° C.; and adding the plurality of carbon nanotubes into the container slowly, while mixing the plurality of carbon nanotubes with the magnesium-based melt by using a stirrer to form the mixture.

11. The method as claimed in claim 10, wherein the magnesium-based melt is filled into a container in a semi-solid state.

12. The method as claimed in claim 1, wherein step (b) further comprises a substep of:

injecting the mixture into the at least one mold in protective gas.

13. The method as claimed in claim 12, wherein the protective gas is made up of at least one of nitrogen, ammonia, and a noble gas.

14. The method as claimed in claim 1, wherein a weight percentage of the plurality of carbon nanotubes in the mixture is about 3%.

15. The method as claimed in claim 1, wherein the material of the magnesium-based melt is pure magnesium, and a weight percentage of the plurality of carbon nanotubes in the mixture is about 3%.

16. The method as claimed in claim 1, wherein the at least one mold comprises a plurality of molds, the at least one preform comprises a plurality of preforms.

17. A method for fabricating a magnesium-based composite material, the method comprising the steps of:

providing a magnesium-based melt and a plurality of carbon nanotubes, mixing the plurality of carbon nanotubes with the magnesium-based melt to achieve a mixture;

injecting the mixture into at least one mold, and cooling down and solidifying the mixture to room temperature to achieve at least one preform;

disposing the at least one preform in an extruding device;

heating the at least one preform to a temperature in an approximate range from 300° C. to 450° C. by the extruding device; and extruding the at least one preform at the temperature in the approximate range from 300° C. to 450° C. to achieve the magnesium-based carbon nanotube composite material.

* * * * *